US007721745B2

(12) United States Patent
Baumann et al.

(10) Patent No.: US 7,721,745 B2
(45) Date of Patent: May 25, 2010

(54) METHOD AND CLEANING DEVICE FOR CLEANING A SPRAYING DEVICE

(75) Inventors: Michael Baumann, Flein (DE); Georg Sommer, Möglingen (DE)

(73) Assignee: Duerr Systems, Inc., Auburn Hills, MI (US)

( * ) Notice: Subject to any disclaimer, the term of this patent is extended or adjusted under 35 U.S.C. 154(b) by 344 days.

(21) Appl. No.: 11/551,671

(22) Filed: Oct. 20, 2006

(65) Prior Publication Data

US 2007/0089762 A1 Apr. 26, 2007

Related U.S. Application Data

(60) Provisional application No. 60/729,475, filed on Oct. 21, 2005, provisional application No. 60/729,442, filed on Oct. 21, 2005.

(51) Int. Cl.
*B08B 3/02* (2006.01)

(52) U.S. Cl. ..... 134/104.2; 118/302

(58) Field of Classification Search ..... 134/34, 134/104.2, 167 R, 170, 182; 118/302
See application file for complete search history.

(56) References Cited

U.S. PATENT DOCUMENTS 4,010,902 A * 3/1977 Speyer ..... 239/428.5
4,422,576 A 12/1983 Saito et al.
4,687,015 A * 8/1987 Mieth ..... 137/238
4,785,760 A * 11/1988 Tholome ..... 118/323
5,855,218 A * 1/1999 Giannetti ..... 134/102.1
5,966,501 A * 10/1999 Miller et al. ..... 392/458

FOREIGN PATENT DOCUMENTS

DE 3 08 801 A1 10/1989
DE 101 10 098 A1 9/2002
DE 2004 019 888 A 11/2004
EP 0 366 021 A2 2/1990
EP 1 367 302 A2 12/2003

OTHER PUBLICATIONS

Machine Translation of EP1367302 (Pub Dec. 3, 2003) by Sommer and Baumann.*
Machine Translation of DE10110098 (Pub Sep. 5, 2002) by Baral.*

* cited by examiner

*Primary Examiner*—Michael Barr
*Assistant Examiner*—Ryan Coleman
(74) *Attorney, Agent, or Firm*—Rader Fishman & Grauer

(57) ABSTRACT

To clean an atomizer used for automatic series-production coating of work pieces in a cleaning device provided for this purpose, the outer housing of the atomizer is sprayed by nozzles of the cleaning device, while simultaneously painting and rinsing agents sprayed by the spray head of the atomizer in a short rinsing process are captured and discharged through a pipe section in the interior of the cleaning device. In electrostatic atomizers, voltage equalization between the atomizer and the cleaning device is performed beforehand. Through additional measures, the atomizer can be moved by the handling machine provided for this purpose only from one proper direction towards the cleaning device.

20 Claims, 2 Drawing Sheets

METHOD AND CLEANING DEVICE FOR CLEANING A SPRAYING DEVICE

CROSS-REFERENCE TO RELATED APPLICATIONS

This application claims benefit of U.S. Provisional Patent Application Ser. No. 60/729,475 filed on Oct. 21, 2005, and also claims the benefit of U.S. Provisional Patent Application Ser. No. 60/729,442 filed Oct. 21, 2005, which is incorporated by reference herein in its entirety.

FIELD OF THE INVENTION

The invention relates to a method and to a cleaning device for cleaning a spraying device used for automatic series-production coating of work pieces, where the spraying device can typically involve the atomizer of conventional painting robots for coating work pieces, such as vehicle car bodies or their parts, in particular, air atomizers or rotary atomizers, including electrostatic atomizers for the internal charging of the sprayed coating material and/or with external charging electrodes.

BACKGROUND

For the completely automatically controlled cleaning of such atomizers required at regular time intervals during the coating operation, various cleaning devices are known, which each consist of a closed housing up to the insertion opening for the atomizer. In the interior of this housing, the inserted part of the air or rotary atomizer is sprayed with cleaning fluid by a rotating or stationary nozzle arrangement of the cleaning device and then can be dried with compressed air. For example, cleaning devices of this type known from EP 1 367 302 or DE 101 10 098 have the disadvantage that they are not suitable for the internal cleaning process, which is typically designated as a short rinse and in which rinsing agent is led from a short rinsing channel of the atomizer through its pain nozzle and, in the case of rotary atomizers, especially in the way known from EP 0 715 896, also from the outside of the rotating bell plate, and is sprayed from the atomizer. This can be useful when changing colors or after the painting of a certain number of car bodies or other work pieces with the same color, in order to remove possible paint deposits on the pain nozzle or on the bell plate. When this internal cleaning process or short rinsing process is performed in known cleaning devices, the greatly swirling mist generated when the painting and rinsing agent mixture is atomized spreads around in the interior of the cleaning device and covers both the interior, including the cleaning nozzle arrangement positioned in the interior, and also the outside of the inserted atomizer. One could certainly first perform the short rinsing and only then spray the outside of the atomizer and clean the interior, but the associated time losses in the series-production coating of work pieces is extremely undesired due to the corresponding production losses. This problem also occurs essentially when, according to EP 0 869 849 or DE 101 29 667, only the spray head or only the air cap of air atomizers is inserted into the cleaning device while eliminating the cleaning of the outside of the atomizer housing.

Another time problem results from the fact that a flammable mist is formed in the interior of cleaning devices, especially for coating and rinsing agents containing organic solvents, and therefore no electrical voltage arcing leading to sparks may be possible. This risk consists in the cleaning of electrostatic atomizers, which are connected to high voltage on the order of magnitude of 100 kV in a known way for contact charging of the sprayed coating material, for example, by the bell plate or for exterior charging by external electrodes. Because the known cleaning devices typically lie at ground potential, the high voltage of the atomizer first must be turned off and discharged before the atomizer is inserted, which means that time losses typically on the order of magnitude of one minute must be taken into account.

SUMMARY

The invention is based on the challenge of presenting a method and a device, respectively, which permit cleaning of the spraying devices required at regular intervals in the coating operation with lower time losses than before.

This challenge is solved according to a first aspect of the invention, when performing the mentioned internal cleaning or short rinsing process in the cleaning device, the agents sprayed from the spray head of the atomizer and composed of paint or other coating material and/or the rinsing agent are sprayed into a discharge device, which is provided within the cleaning device and which prevents these agents from reaching areas of the interior of the cleaning device lying outside of the discharge device and/or the outside of the atomizer. According to one embodiment, this discharge device contains a pipe section, which can be arranged with its inlet opening in the vicinity of the spray head or simply surrounding this spray head in the interior of the cleaning device. This pipe section can lead the paint and rinsing agent mixture sprayed from the atomizer into the interior outlet device or can lead out of the cleaning device. Other discharge devices suitable for the considered purpose, for example, blowing or suction devices, are also conceivable for the mist generated by the atomizer. In each case, the invention has the advantage that it does not lead to contamination of the interior of the cleaning device due to the swirling mist and it prevents the previous additional and/or renewed contamination of the part of the atomizer to be cleaned, which was inserted into the cleaning device. Because the short rinsing process and the external cleaning of the atomizer performed in the same device do not affect each other according to the invention, these two processes can be performed in parallel, that is, simultaneously, which produces corresponding time savings for the entire cleaning process. In addition, maintenance costs are reduced by the lower contamination of the cleaning device.

In addition, according the invention the mentioned risk of explosion for cleaning devices can be avoided when the charging device of the spraying device is set to the electrical potential of the cleaning device or the cleaning device is set to the electrical potential of the charging device before the beginning of the cleaning and preferably before the insertion of the atomizer into the cleaning device. The cleaning device can be set to a high voltage, at least when approaching the atomizer, when it is provided with corresponding electrical insulation and when it is mounted or arranged at a sufficient distance from all of the grounded parts of the coating system. In other cases, when the associated space requirements and the similarly resulting increase in the electrical total capacitance of the system are to be avoided, it can be useful to ground the atomizer when and/or before it is inserted into the cleaning device. In this aspect, the invention touches upon the knowledge that a quicker discharge of the high-voltage potential of the charging device of the atomizer, typically on the order of magnitude of milliseconds, is sufficient for the voltage equalization, so that the time losses associated with turning off the high-voltage generator and the total voltage discharge can be avoided and the cleaning can begin practically with no delay after a coating process and then another coating process can begin immediately after the cleaning.

For the quick grounding of the atomizer, there are various possibilities. For example, the charging device of the atomizer can be grounded by an automatically controlled switch connected to the charging device. Alternatively or additionally, the atomizer can be grounded by the cleaning device itself. In particular, the atomizer can be brought into a grounded contact arrangement of the cleaning device, with which the charging device of the atomizer is brought into contact, by the coating machine, e.g., a painting robot or by a handling machine for inserting the atomizer into the cleaning device.

According to another feature of the invention, an alarm signal is generated and/or the handling machine is brought to a stop when the atomizer approaches the cleaning device from a direction that deviates from the direction set by the movement control program of the machine. In particular, through a special control program for the handling machine moving the atomizer towards the cleaning device, in a known way a limited space is defined for the movement of the atomizer in the surroundings of the cleaning device. This space is blocked by the control program for the movement of the atomizer when it approaches from a direction that is different than the set direction. Through these measures, it is initially guaranteed that the atomizer is always inserted in the correct way into the device without the risk of colliding with the cleaning device. In addition, there is the advantage that the atomizer must pass, with certainty, a proximity sensor on the given path for monitoring the approach of the atomizer towards the cleaning device for triggering the correctly timed voltage equalization, so that the reliability of the explosion protection is also increased.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
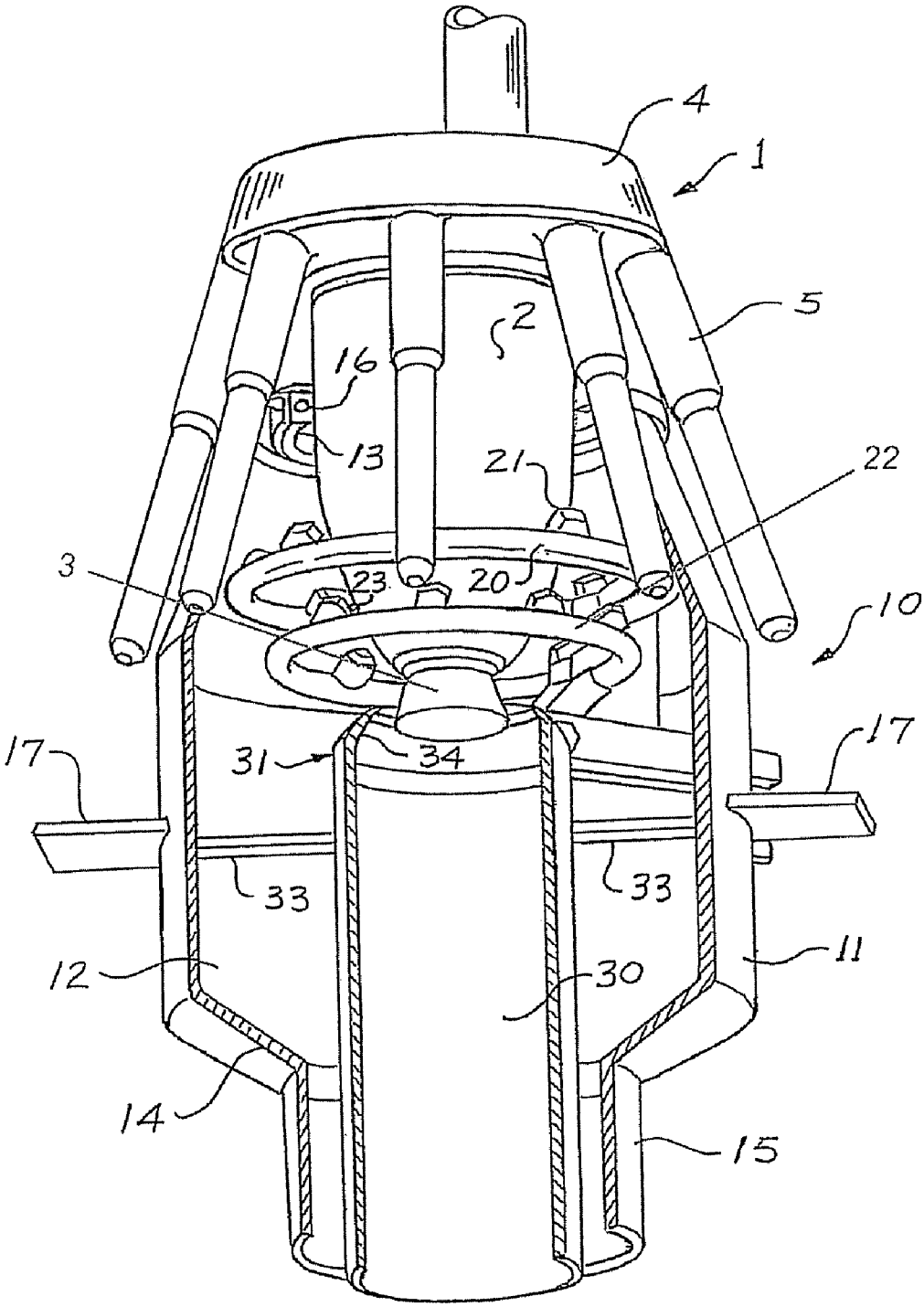
FIG. 1, a possible embodiment of a cleaning device for a rotary atomizer.

According to FIG. 1, a rotary atomizer 1 of conventional construction with the cylindrical and conical outer housing 2, the bell plate 3, and the external electrodes 5 distributed around the outer housing and projecting axially from the supporting ring 4 is inserted into the cleaning device 10 described here. The cleaning device 10 can be arranged, e.g., in a painting cabin and is composed essentially of a housing body 11, whose interior 12 can extend from the circular insertion opening 13, for example, initially conically and then cylindrically up to a funnel-shaped base part 14 with a cylindrical outlet 15. According to the representation, the rotary atomizer 1 is inserted coaxially with the center axis of the housing body 11 into the cleaning device 10, so that the insertion opening 13 encloses the cylindrical part of its outer housing 2 and its end facing away from the bell plate is located outside of the cleaning device or at least the housing body 11 with the supporting ring 4 and the external electrodes 5. Through its part expanding conically from the insertion opening 13, the shape of the housing body 11 is adapted to the direction, in which the external electrodes 5 project from the supporting ring 4. Instead of the shown example, it is also possible to insert the rotary atomizer 1 completely or at least with its external electrodes 5 into the interior of the housing of the cleaning device or the external electrodes 5 into separate inner spaces of the cleaning device. The interior 12 of the shown cleaning device 10 should be sealed tight from the outside when an atomizer is inserted and is therefore provided at the insertion opening 13 with a sealing arrangement 16 extending around the periphery of the outer housing 2, for example, with a contactless pneumatic seal, which can be formed by one of the annular air nozzle arrangements mentioned or described in EP 1 367 302. The cylindrical outlet 15 can lead into a not-shown disposal device and can be closed. The housing body 11 of the cleaning device can be fixed to an external holder with flange parts 17.

For cleaning the outside of the part of the outer housing 2 of the atomizer inserted into the interior 12, the cleaning device 10 has a ring body 20, which is arranged concentric to the axes of the rotary atomizer and the housing body 11, which forms or contains a feed line for a cleaning fluid suitable as a paint solvent, and on which there are cleaning nozzles 21 distributed around the center axis of the cleaning device, connected to the mentioned feel line, and directed towards the outside of the outer housing 2. A second ring body 22, which forms or contains a compressed air or compressed gas line and on which nozzles 23 are arranged, from which air or gas is blown for drying the outer housing 2, similarly directed towards the outer housing 2, is mounted in the interior 12 in parallel and concentric to the ring body 20 in a similar way. A single ring body could also be sufficient, which is provided both with nozzles for the solvent and also with blowing nozzles and associated lines, while, on the other hand, two or more ring bodies each provided with solvent and/or blowing nozzles can also be provided. Nozzle arrangements used for cleaning and/or drying the atomizer housing could also be arranged directly on the wall of the interior 12 of the cleaning device 10. For the shown example, the bottommost ring body 22, that is, the one farthest away from the insertion opening 13, is located axially close to the bell-side end of the outer housing 2. The nozzle arrangements can be fed by solvent or compressed air lines, which lead from the cabin into the cleaning device.

Although a cleaning or blowing-nozzle arrangement that is stationary in the cleaning device, such as the nozzles 21 and 23, is usually preferred, in other cases, nozzle arrangements that can rotate or pivot about the atomizer can also be provided.

For improving the cleaning or drying effect, it can be useful to heat the solvent or other cleaning media and/or compressed gas fed to the nozzles. The heating can be performed by an electric heating device, a heating device formed by a heat exchanger, or some other heating device outside or inside the cleaning device or possibly also inside the nozzle arrangement. By heating the compressed gas, cooling by the gas expanding at the nozzle, which can lead to the formation of condensation, can also be avoided.

According to a special embodiment, the blowing nozzles 23 can be constructed, in principle, in a known way ("dry jet"® of the company SATA), so that the flow of the compressed air fed from the outside, e.g., from a compressed air connection of the cabin, in or to the blowing nozzle generates a negative pressure, which draws additional air from the surroundings of the blowing nozzle. The drawn surrounding air can be led through a filter of the blowing nozzle and therefore cleaned before it is led to the atomizer mixed with the main flow.

As was explained above, agents sprayed from the bell plate 3 of the rotary atomizer 1 inserted into the cleaning device 10, e.g., residual paint, rinsing fluid, and their mixture should be prevented from reaching and contaminating the outer housing 2 of the atomizer or the walls of the interior 12 or parts of the cleaning device located in this interior, in particular, the ring bodies 20 and 22 and their nozzles. For this reason, a cylindrical inner pipe section 30 is mounted in the interior 12 coaxial to the center axis of the housing body 11. The agents are sprayed from the bell plate 3 into the open inlet end 31 of this inner pipe section facing the atomizer 1. The internal diameter of the inner pipe section 30 is larger, at least at the inlet end 31, than the outer diameter of the bell plate 3, while its own outer diameter can be smaller than the inner diameter of the interior 12 of the housing body 11, on whose inner wall the inner pipe section 30 can be mounted, for example, with radial transverse supports 33. The inlet end 31 of the inner pipe section 30 can be positioned axially, so that the spray edge at the end of the bell plate 3 is located within the inner pipe section 30 and the axially rear bell plate part is located outside. The inner pipe section 30 can have on its inlet end 31 an end piece 34 tapering conically outwards up to the inlet opening surrounding the bell plate. In the direction away from the inlet end 31, the inner pipe section 30 extends into or through the outlet 15 of the cleaning device 10. It can open into the cleaning device itself or into an external disposal device.

The cleaning device described here is also suitable for cleaning atomizers of other types, for example, rotary atomizers without external electrodes or air atomizers, whose spray head is not formed by a rotating bell plate like in the shown example, but instead by the conventional stationary nozzle and air cap arrangement. The housing and inner pipe section of the cleaning device can be modified here according to the corresponding atomizer type.

In operation, the spraying device to be cleaned, that is, here the rotary atomizer 1, is introduced coming from a direction parallel to the center axis of the housing and pipe section 11, 30 and concentric to this axis into the cleaning device 10, for example, vertically from above, although any arbitrary direction is possible with an appropriate arrangement of the cleaning device 10. The painting robot, with which a workpiece had just been painted, or in other cases, for example, also a handling robot provided for this purpose or some other handling device, which automatically tales the atomizer from the coating machine, can be used for inserting the atomizer into the cleaning device. As soon as the atomizer is located in the position shown in FIG. 1, the short rinsing or internal cleaning process can begin, in which the rotating bell plate sprays residual paint and rinsing medium into the inner pipe section 30, and also simultaneously the external cleaning of the atomizer can begin immediately by spraying its outer housing through the nozzles 21. Likewise, if necessary the air nozzles of the sealing arrangement 16 can also be turned on. After the spraying, the outer housing 2 is dried by the compressed air nozzles 23. While the cleaning fluid of the nozzles 21 collecting in the interior 12 is discharged in a known way through the funnel-shaped base part 14 and the outlet 15, the media sprayed by the bell plate is led out from the cleaning device through the pipe section 30. After these cleaning processes end, the atomizer can be pulled immediately from the cleaning device and used for the next coating process.

The external electrodes 5 of the rotary atomizer to be cleaned according to FIG. 1 or in other cases electrostatic air atomizers or other atomizers are connected in a known way to high voltage on the order of magnitude of 100 kV for the workpiece coating. Because no electrical arcing may be possible when such electrostatic atomizers approach the cleaning device 10 for reasons of explosion protection and other safety concerns, according to a special feature of the invention, the atomizer is set to the electrical potential of the cleaning device, for example, ground potential, or the cleaning device is set to the electrical potential of the atomizer, before the beginning of the cleaning and preferably during its approach to the cleaning device before the atomizer is inserted.

For avoiding voltage arcing, one could first turn off the high voltage after a coating process. In many cases, however, it would not be useful to first turn off the high-voltage generator of the atomizer completely, that is, including its own power supply, after a coating process and before the startup of the cleaning device, because here the discharge of the high voltage and the reactivation process necessary after the cleaning take an undesirably long time and can result in associated production delays. In such cases, there are various possibilities for the voltage equalization according to the invention.

A first possibility exists in electrically isolating the cleaning device and charging it to the high-voltage potential of the electrical atomizer, e.g., by connecting it to the high-voltage generator of the atomizer in parallel to the atomizer, wherein a switching device can be provided, with which this parallel circuit can be alternately set to a high-voltage potential and grounded.

In contrast if the cleaning device is to be grounded constantly, according to the invention the atomizer is also grounded, whereby, in turn, various possibilities exist that result in no or only minimal time loss. A simple possibility is the circuit shown schematically in FIG. 2, in which, between the high-voltage generator HS and the charging device (electrodes) of the atomizer Z, a program-controlled ground switch ES is connected, with which the atomizer is separated from the high-voltage generator and set to ground potential before reaching the grounded cleaning device RG. The ground switch ES can be located outside or inside the handling machine or the atomizer. Although the ground switch purposefully can contain known resistance or other attenuation devices, the atomizer can be discharged in an extremely short time with the ground switch ES. This discharge, which is more or less attenuated according to the conditions, can be performed without time loss when the atomizer is moved towards the cleaning device.

For preventing a safety risk, the time when the atomizer is grounded (or the voltage equalization by charging the cleaning device) is preferably controlled as a function of the approach of the atomizer to the cleaning device. Because the approaching speed in the path of the atomizer is known since the control program of the robot is preset, one can define a sufficient safety distance from the cleaning device. When the atomizer moves below this safety distance, this condition triggers the grounding or voltage equalization. Reaching the safety limit can be monitored and reported on by a proximity sensor, e.g., in the form of a light barrier, a laser scanning device, or the like. The safety distance, at which the grounding or voltage equalization must be triggered, can be calculated from the known air-insulation distance between the high-voltage potential and ground plus the path covered by the atomizer in the time necessary for the proximity sensor to respond and for the switch over, that is, for example, in the grounding case, for a ground switch to respond and for the subsequent quick discharge of the atomizer.

Figure 3:
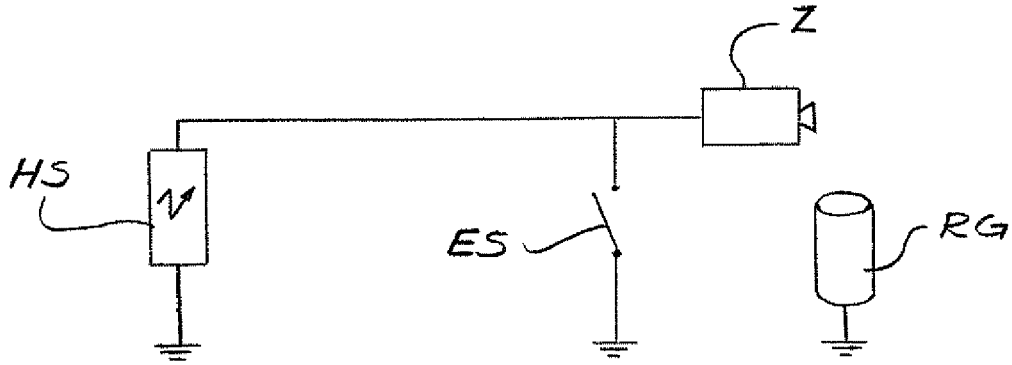
FIG. 3, a circuit arrangement modified relative to FIG. 2.

According to a possible alternative shown in FIG. 3 for grounding the atomizer Z with a ground switch ES', the atomizer can remain connected to the active high-voltage generator HS during the grounding, to which the ground switch ES' is connected in parallel. Through control measures, the high-voltage generator HS can be prevented from turning off due to this short circuit.

Figure 2:
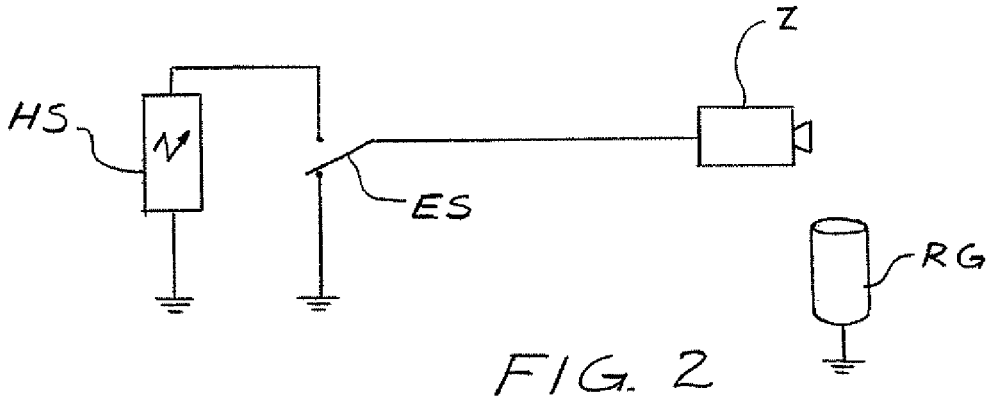
FIG. 2, is a schematically simplified circuit arrangement for grounding an atomizer when approaching a cleaning device.

The two possibilities according to FIGS. 2 and 3 can be further modified or expanded to the extent that instead of or in addition to the ground switch ES or ES', the grounded cleaning device RG itself contacts and therefore grounds the electrode and charging device of the atomizer Z when the atomizer approaches. For example, the high-voltage potential on the atomizer can be discharged in a very short time, in that the atomizer, when reaching its end position in the cleaning device or during its insertion movement, touches a grounded contact arrangement of the cleaning device. This contact arrangement can involve several contact elements, for example, a grounded flexible curtain made from individual wires, which the atomizer passes through during its insertion movement.

Figure 4:
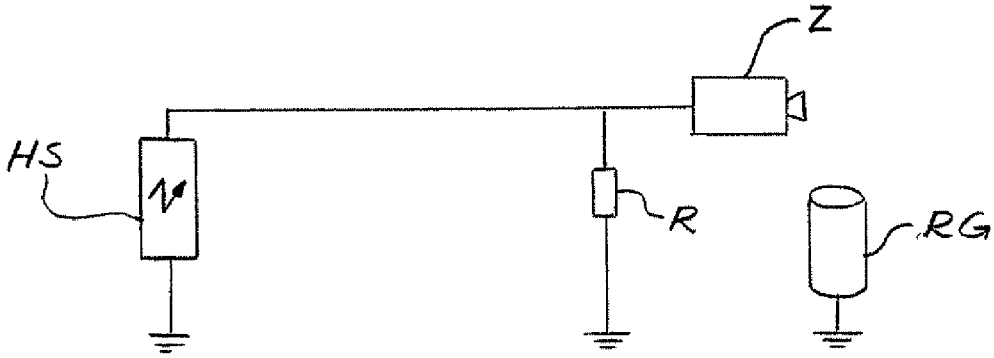
FIG. 4, another possible circuit for grounding the atomizer.

As shown schematically in FIG. 4, the atomizer could also be grounded without a ground switch and without a direct contact to ground. In this variant, before the atomizer reaches the cleaning device RG, the output voltage of the high-voltage generator HS is adjusted downwards by automatically controlled reduction of its desired voltage value, which is set or which is preset at least approximately to zero, e.g., by the control program of the system, without turning off the high-voltage generator. The high-voltage potential on the atomizer is then discharged very quickly and preferably also during the feeding movement of the atomizer by a resistor R connected to ground in parallel with the high-voltage generator HS.

In the other grounding possibilities described above, e.g., in the grounding by the cleaning device itself it can also be useful to adjust the output voltage of the high-voltage generator downwards at an earlier time in the explained way.

So that the spraying device, for example, the rotary atomizer 1 in FIG. 1, can be inserted easily and reliably by the machine provided for this purpose into the cleaning device 10, it must approach the cleaning device from the proper direction, for example, at a right angle from above for a vertical arrangement of the cleaning device. In addition, the proper direction is also important when the atomizer is to pass the proximity sensor named above during its movement towards the cleaning device, so that the necessary voltage equalization can be performed at the proper time. The correct path is given by the movement program of the machine moving the atomizer towards the cleaning device, but deviations from the prescribed path can be produced by errors and thus errors are produced in the proximity sensor or collisions are caused between the atomizer and the cleaning device. To prevent collisions and/or safety risks associated with the danger of explosion due to voltage arcing, according to the feature of the invention explained in more detail above, the atomizer can approach the cleaning device only from the prescribed direction, for example, in FIG. 1 only at a right angle from above. For this purpose, it is known in the field of robot control that a limited virtual blocking space can be defined in the surroundings of the cleaning device, in which the atomizer can be moved, e.g., only at a right angle from above. Possibilities are described, for example, in EP 1 332 841, EP 1 035 953, and DE 102004019888.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A cleaning device for cleaning a spraying device having a spray head, the cleaning device comprising:

a housing body defining an insertion opening, an outlet opening, and an interior cavity disposed between the insertion opening and the outlet opening, the insertion opening configured to receive the spraying device;

at least one nozzle arranged in the interior cavity, the at least one nozzle connected to a feed line arrangement for at least one of a cleaning agent and a compressed gas, the at least one nozzle directed towards an outside of the inserted spraying device; and a discharge device disposed at least partially within the interior of the cleaning device, the discharge device including a tube having an open inlet end within the interior of the cleaning device, the open inlet end configured to receive the spray head of the spraying device when the spraying device is inserted into the cleaning device such that the discharge device blocks the sprayed medium from reaching the interior of the housing body and the at least one nozzle.

2. The cleaning device of claim 1, wherein an interior wall defines in part the interior of the housing body, the interior wall extending from the insertion opening to the outlet opening, and wherein the tube is configured to receive the spray head of the spraying device when the spraying device is inserted into the cleaning device such that the tube blocks the sprayed medium from reaching the interior wall of the housing body.

3. The cleaning device of claim 2, wherein the tube is supported by at least one support member extending from the interior wall of the housing body to the tube.

4. The cleaning device of claim 3, characterized in that the tube is arranged concentric to the insertion opening of the housing body, such that the spray head is located at an input end of the tube.

5. The cleaning device of claim 4, characterized in that the tube opens into the interior of the housing body at an end opposite the input end.

6. The cleaning device of claim 3, characterized in that the tube opens outside of the housing body.

7. The cleaning device of claim 1, characterized in that the at least one nozzle is attached to a ring arrangement arranged at least approximately concentric to a longitudinal axis of the inserted spraying device and containing a part of the feed line arrangement.

8. The cleaning device of claim 1, characterized in that the nozzles are fixed in the interior of the housing body.

9. The cleaning device of claim 1, characterized in that a heating device is provided for heating at least one of the cleaning agent and the compressed gas.

10. The cleaning device of claim 1, characterized in that compressed gas nozzles are provided, which are connected to a compressed gas line leading into a cleaning device and which draw air through a compressed gas flow from the surroundings of the nozzles.

11. The cleaning device of claim 1, characterized in that an annular air nozzle arrangement, which extends in a ring around an insertion opening and which forms a pneumatic seal between a peripheral edge of the insertion opening and a periphery of an inserted part of the spraying device, is provided at the insertion opening of the interior of the cleaning device, in which the spraying device is inserted with its part to be cleaned.

12. The cleaning device of claim 1, characterized in that the cleaning device is connectable to an electrical ground line and is provided with a contact arrangement for grounding an inserted spraying device.

13. The cleaning device of claim 1, characterized in that the cleaning device is connectable to an electrical high-voltage line, with which it is set to a high-voltage potential of an electrostatic spraying device.

14. A spraying system, including:

a spraying device having a spray head configured to spray a medium; and a cleaning device cleaning the spraying device, the cleaning device including:

a housing body defining an insertion opening, an outlet opening, and an interior cavity disposed between the insertion opening and the outlet opening, the insertion opening receiving the spray head therein;

at least one nozzle arranged in the interior cavity, the nozzle connected to a feed line arrangement for at least one of a cleaning agent and a compressed gas, the at least one nozzle directed towards an outside of the spraying device; and a discharge device disposed at least partially within the interior of the cleaning device, the discharge device including a tube having an opening within the interior of the cleaning device, the opening receiving the spray head such that the discharge device blocks the medium sprayed from the spray head, thereby preventing the medium from reaching the interior of the housing body and the at least one nozzle.

15. The spraying system of claim 14, wherein an interior wall defines in part the interior of the housing body, the interior wall extending from the insertion opening to the outlet opening, and the tube is supported by at least one support member extending from the interior wall of the housing body to the tube.

16. The spraying system of claim 14, wherein the at least one nozzle is fixed within the interior of the housing body.

17. The spraying system of claim 14, characterized in that the cleaning device is in electrical communication with an electrical ground line, the cleaning device including a contact arrangement for grounding the spraying device.

18. The spraying system of claim 14, wherein the spraying device is an electrostatic spraying device, and further including an electrical line having a first electrical potential generally equal to a second electrical potential, the second electrical potential in communication with the electrostatic spraying device.

19. The cleaning device of claim 1, wherein the interior defines an interior wall extending between the insertion opening and the outlet opening, and the discharge device cooperates with the interior wall to define a first flow path extending toward the outlet opening, and the discharge device defines a second flow path extending toward the outlet opening, the discharge device separating the sprayed medium in the second flow path from the first flow path.

20. The cleaning device of claim 19, wherein the first flow path encloses an entire periphery of the separated second flow path along an entire extent of the separated second flow path along a center axis of the housing body.

* * * * *